US012628926B2

(12) United States Patent
Rizzi

(10) Patent No.: US 12,628,926 B2
(45) Date of Patent: May 19, 2026

(54) SUITCASE

(71) Applicant: Giampietro Rizzi, Vignovo (IT)

(72) Inventor: Giampietro Rizzi, Vignovo (IT)

(73) Assignee: Giampietro Rizzi, Vignovo (IT)

( * ) Notice: Subject to any disclaimer, the term of this patent is extended or adjusted under 35 U.S.C. 154(b) by 16 days.

(21) Appl. No.: 18/291,982

(22) PCT Filed: Jul. 26, 2022

(86) PCT No.: PCT/EP2022/070977
§ 371 (c)(1),
(2) Date: Jan. 25, 2024

(87) PCT Pub. No.: WO2023/006767
PCT Pub. Date: Feb. 2, 2023

(65) Prior Publication Data

US 2025/0017341 A1 Jan. 16, 2025

(30) Foreign Application Priority Data

Jul. 28, 2021 (IT) ..... 102021000020186

(51) Int. Cl.
*A45C 13/26* (2006.01)
*A45C 5/03* (2006.01)

(52) U.S. Cl.
CPC ..... *A45C 13/262* (2013.01); *A45C 5/03* (2013.01); *A45C 2013/267* (2013.01); *A45C 2200/15* (2013.01)

(58) Field of Classification Search
CPC ... A45C 13/262; A45C 5/03; A45C 2013/267; A45C 2200/15
See application file for complete search history.

(56) References Cited

U.S. PATENT DOCUMENTS 2,609,072 A * 9/1952 Levinson ..... A47B 3/10 190/11
6,193,033 B1 * 2/2001 Sadow ..... B62B 1/125 280/37

(Continued)

FOREIGN PATENT DOCUMENTS

CN 213786082 U 7/2021
WO 2011056754 A1 5/2011

OTHER PUBLICATIONS

International Search Report for PCT/EP2022/070977 Mailed on Dec. 6, 2022.

*Primary Examiner* — Tri M Mai
(74) *Attorney, Agent, or Firm* — Rivka Friedman

(57) ABSTRACT

This finding regards a suitcase (1) which comprises, on at least one side wall thereof, a handle (2) comprising a lower portion (3) and an upper portion (4), it being provided that each of said portions (3, 4) of the handle (2) is hinged to the side wall by its own connection means, so as to be able to switch from a configuration wherein they are substantially parallel to said wall to one wherein they are substantially orthogonal to said wall. Said connection means between the side wall and the portions (3, 4) of the handle (2) comprise a central body (7) fixed to said wall and to which at least one rotatable side end (8) is connected, able to rotate about an axis parallel to the side wall. The upper portion (4) is slidable through the relative rotatable side end (8) and that stop elements are provided to block said sliding, so as to adjust the vertical position of said upper portion (4).

4 Claims, 12 Drawing Sheets

(56) References Cited

U.S. PATENT DOCUMENTS

| | | | | |
|---|---|---|---|---|
| 8,016,089 | B1 * | 9/2011 | McNichols | A45C 5/14<br>190/18 R |
| 9,295,311 | B2 * | 3/2016 | Gadzinski | A45C 5/14 |
| 9,867,437 | B1 * | 1/2018 | Dohmann | A45C 15/06 |
| 11,413,106 | B2 * | 8/2022 | Purpura | A45C 5/03 |
| 2015/0313334 | A1 | 11/2015 | Gadzinski et al. | |

* cited by examiner

SUITCASE

TECHNICAL FIELD

Suitcases accompany millions of travellers on their journeys every day, as they are needed to transport basic necessities such as clothes, medicines or portable electronics, which will be needed during one's stay away from home.

BACKGROUND

Nowadays, many travellers move for business reasons and they do not usually stay in one location for a long time, and during a single trip they travel even up to 4 or 5 different cities to meet customers and do business. Since the time spent in the hotel is kept to a minimum and usually only dedicated to rest, so as to make use of the entire working day, this type of traveller has no interest in booking a particularly spacious hotel room and, also for economic reasons, he stays in single, small rooms that offer the minimum space necessary to move around.

In these situations, or in any situation in which no table, chair or piece of furniture is available on which to place the open suitcase, one is forced to place it on the bed in the room, occupying it, or even on the floor to open it and thus one is forced to bend down to pick up one's belongings.

In order to overcome these drawbacks, it would be useful to have a suitcase equipped with support legs, so that it can be used in a similar way to a portable chest of drawers, simply by placing it on its legs and opening it, avoiding occupying the bed or having to bend down to reach out to the ground.

An example of a similar device is described in patent document CN103169227, wherein a suitcase convertible into a table is disclosed. The device has four telescopic legs that can be folded over the body of the suitcase and can be pulled out when the user wishes to.

This solution is not optimal, as the telescopic legs are independent of each other and, should they accidentally get hooked on an element of the surrounding environment during the transport of the suitcase, they would open up, constituting a nuisance and also a danger to the user who might inadvertently hit other people or delicate objects with the protruding legs.

In the patent document CN 213786082 U (cited references relates to said document—see also the figures) a suitcase 1 with support legs (5, 51, 52) is shown which comprises, on at least one side wall thereof, a handle (a support frame 5"+fixing member 54" can be regarded as a handle) comprising a lower portion (e.g. one of the legs 51) and an upper portion (e.g. one of the legs 51), said portions (3, 4) of the handle (2) being hinged to the side wall by respective connection means ("hinged to the bottom of the housing"), so as to be able to switch from a configuration wherein they are substantially parallel to said wall (FIGS. 2, 3) to one wherein they are substantially orthogonal to said wall (FIG. 1).

Similar features are known from the patent documents US 2015/313334 A1, WO 2011/056754 A1 and U.S. Pat. No. 9,867,437 B1.

SUMMARY

The main aim of this invention is to improve the operation and user-friendliness of such suitcases.

This is achieved, according to the invention, by providing, according to the characteristics of claim 1, that the connection means between the side wall and the portions of the handle comprise a central body fixed to said wall and to which two rotatable side ends are connected, able to rotate about an axis parallel to the side wall; it being further provided that the upper portion is slidable through the relative rotatable side ends and that stop elements are provided to block said sliding, so as to adjust the vertical position of the upper portion.

Further features of the invention are present in the dependent claims.

BRIEF DESCRIPTION OF THE DRAWINGS

The invention will be better defined through the description of a possible embodiment thereof, given solely by way of non-limiting example, with the aid of the attached drawings, wherein.

DETAILED DESCRIPTION

Figure 1:
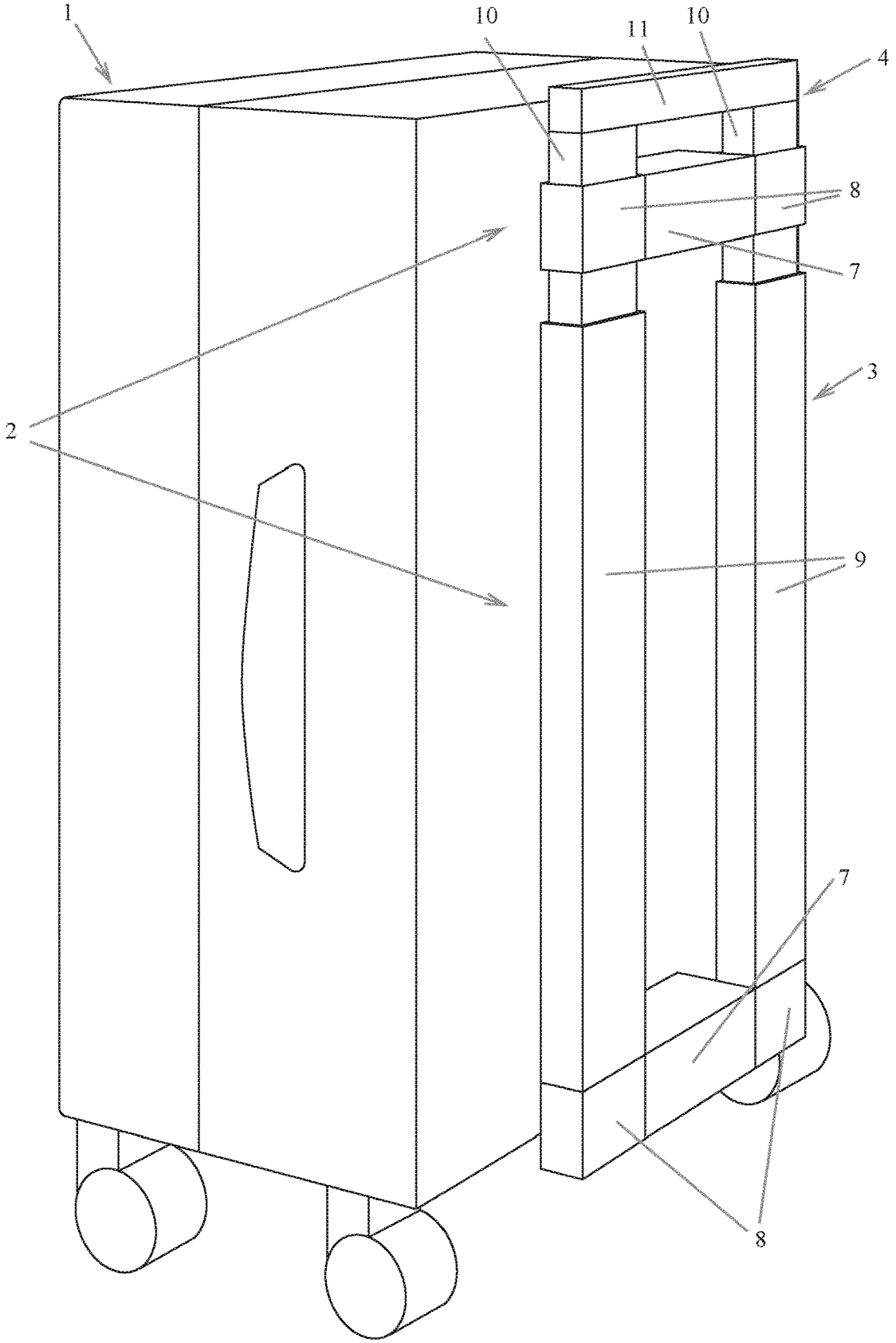
FIG. 1 illustrates a perspective view of a suitcase referred to in the invention.
Figure 2:
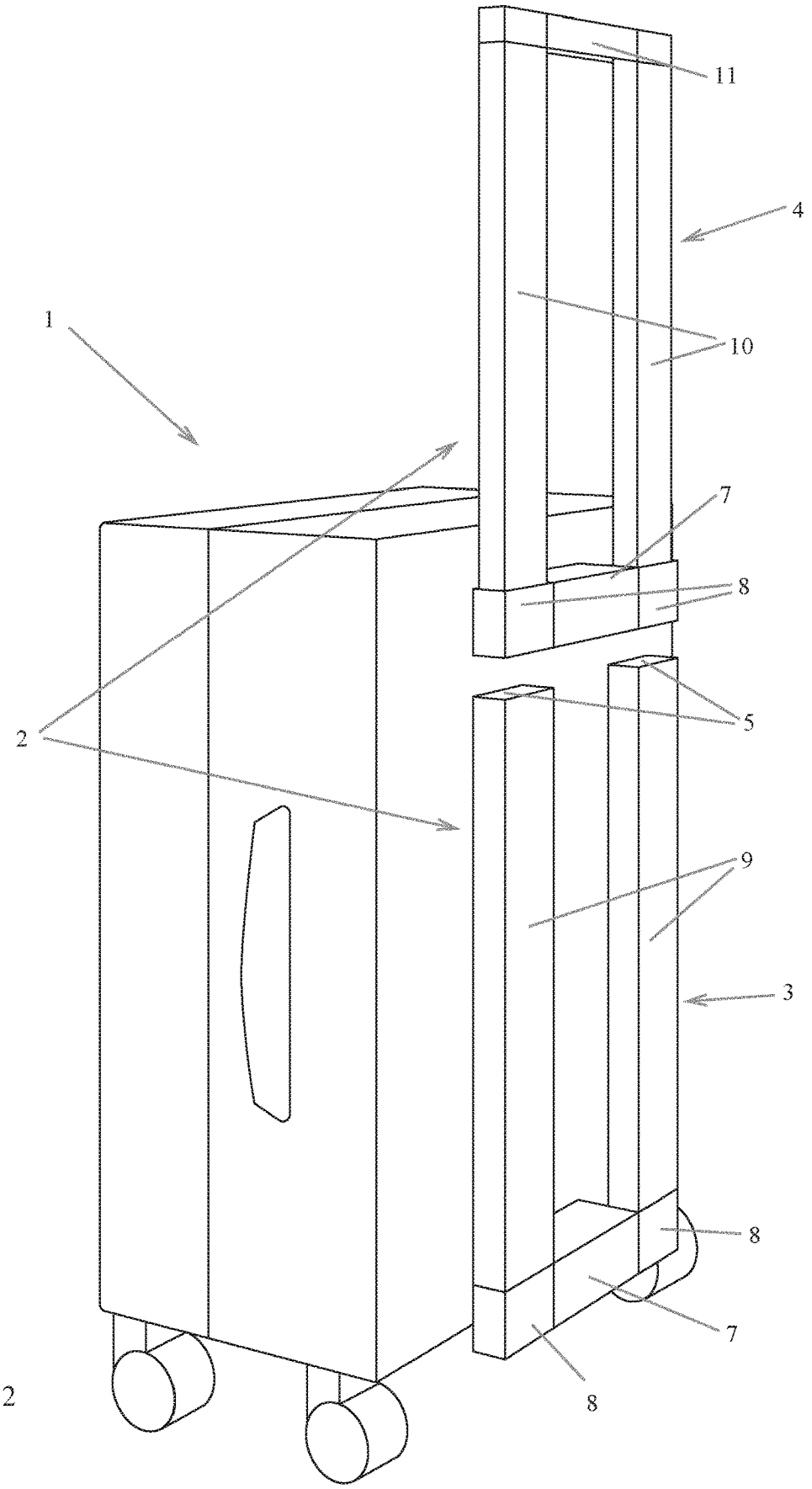
FIG. 2 illustrates a perspective view of the suitcase of FIG. 1 with the elongated handle.
Figure 3:
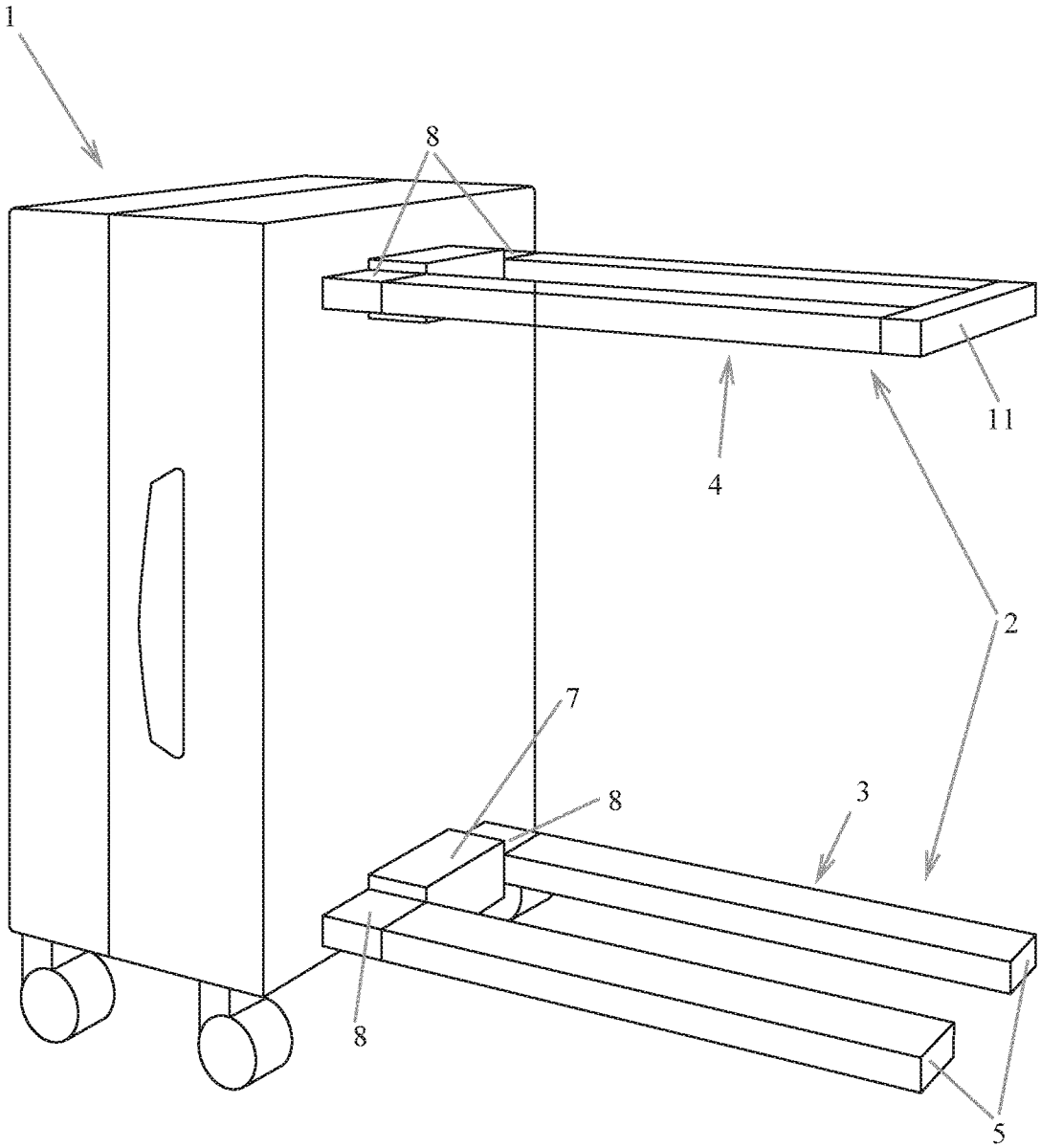
FIG. 3 illustrates a perspective view of the suitcase of FIGS. 1 and 2 with the portions of the handle in orthogonal configuration.

As can be seen from FIGS. 1-3, the suitcase referred to in the invention comprises on at least one side wall thereof a handle 2 usable by the user for normal transport, comprising a lower portion 3 and an upper portion 4, which are hinged to the side wall by means of respective connection means, so as to be able to switch from a configuration wherein they are substantially parallel to said wall, to one wherein they are substantially orthogonal. Any type of connection that allows this configuration variation can be used for this purpose.

In the embodiment in question, the connection means between the side wall and the portions 3, 4 of the handle 2 comprise, respectively, a central body 7 fixed to said wall and to which two rotatable side ends 8 are connected, able to rotate about an axis parallel to the side wall. It can be further provided that the upper portion 4 can slide through the relative rotatable side ends 8 and that stop elements are provided to block said sliding, so as to adjust the vertical position of the upper portion 4. In an embodiment that is not shown, it could be provided even a single rotatable side end 8. In general, the rotatable side ends 8 can be at least one.

In order to make the whole system compact, it is preferable that the lower portion 3 is hollow and has at least one opening 5 at its non-hinged end, and that the upper portion 4 has a cross section having a dimension smaller than that of the lower portion 3, so that while said portions 3, 4 are in a configuration parallel to the wall, the upper portion 4 can slip into the lower portion 3 through said opening 5.

In the illustrated embodiment, the lower and upper portions respectively comprise two straight arms 9, 10.

The arms 9 of the lower portion 3 each have an opening 5 to receive the arms 10 of the upper portion 4 when the user wishes to close the handle 2 along the body of the suitcase 1.

For convenience, the upper portion 4 may comprise a handle 11 which may be coated with materials at high coefficient of friction, such as rubber, to ensure a firm grip to the user.

Figure 4:
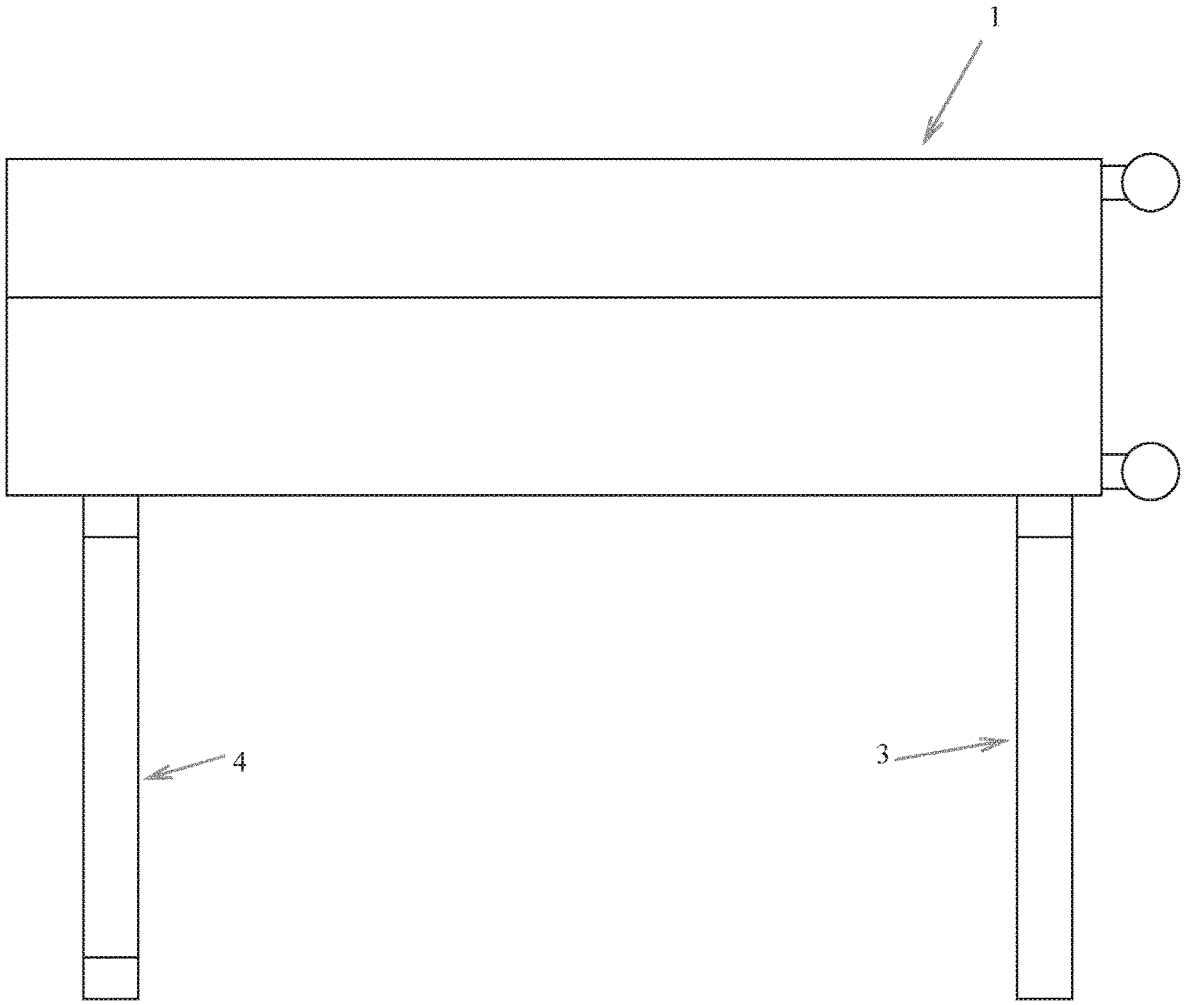
FIG. 4 illustrates a side view of a suitcase referred to in the invention converted into a little table.
Figure 5:
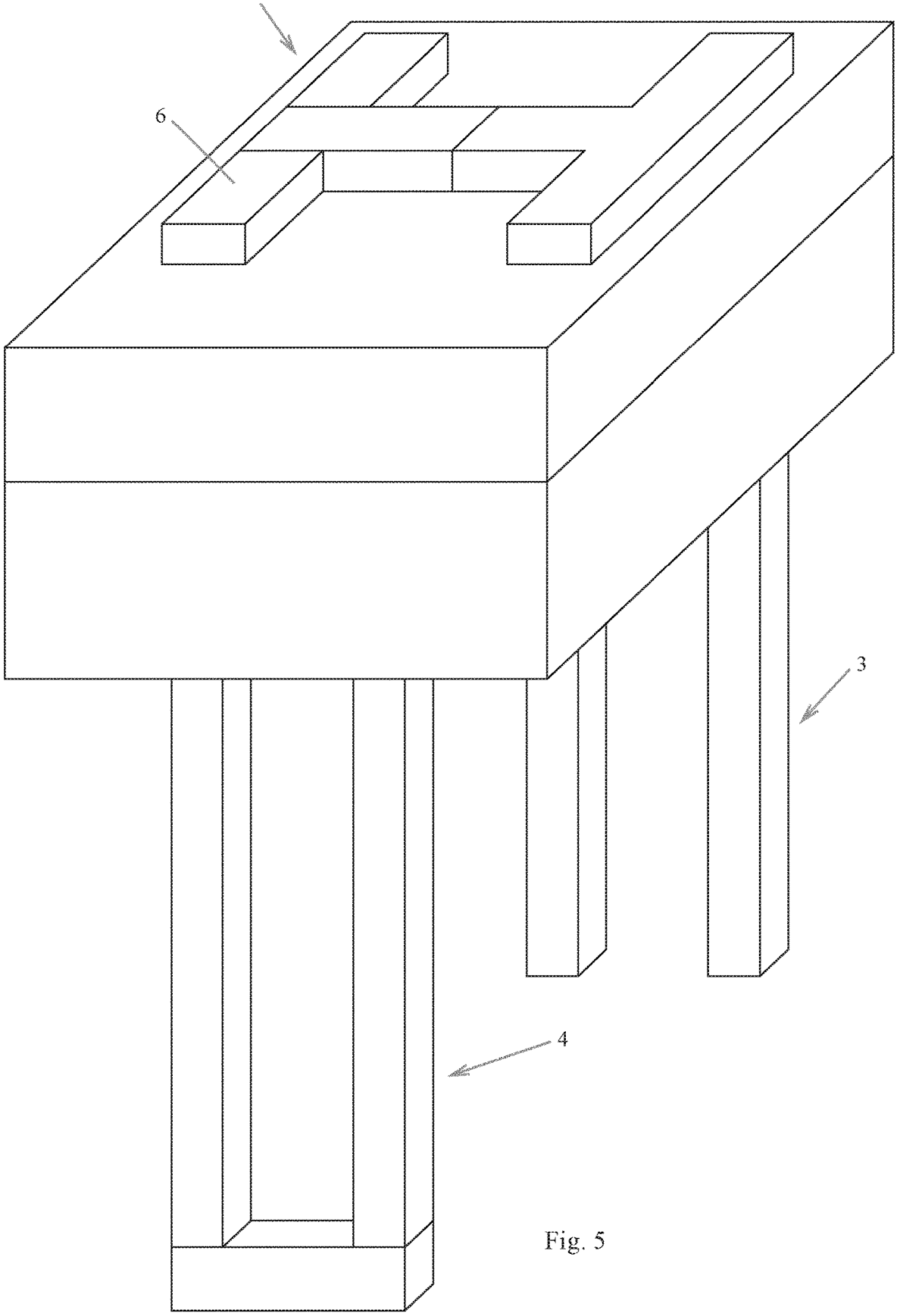
FIG. 5 illustrates a perspective view of a suitcase of the invention having a support arm.

FIG. 4 shows how easy it is to convert the suitcase 1 into a little table by exploiting the special configuration of the handle 2.

In order to increase the stability of the suitcase 1, in particular when the user wishes to arrange the two half-shells that compose it parallel to each other, it is possible to provide, at the side wall opposite to that having the handle 2, a support arm 6 hinged to said wall, so as to be able to switch from a configuration wherein it is substantially parallel to it, to one wherein it is substantially perpendicular to it.

Figure 6:
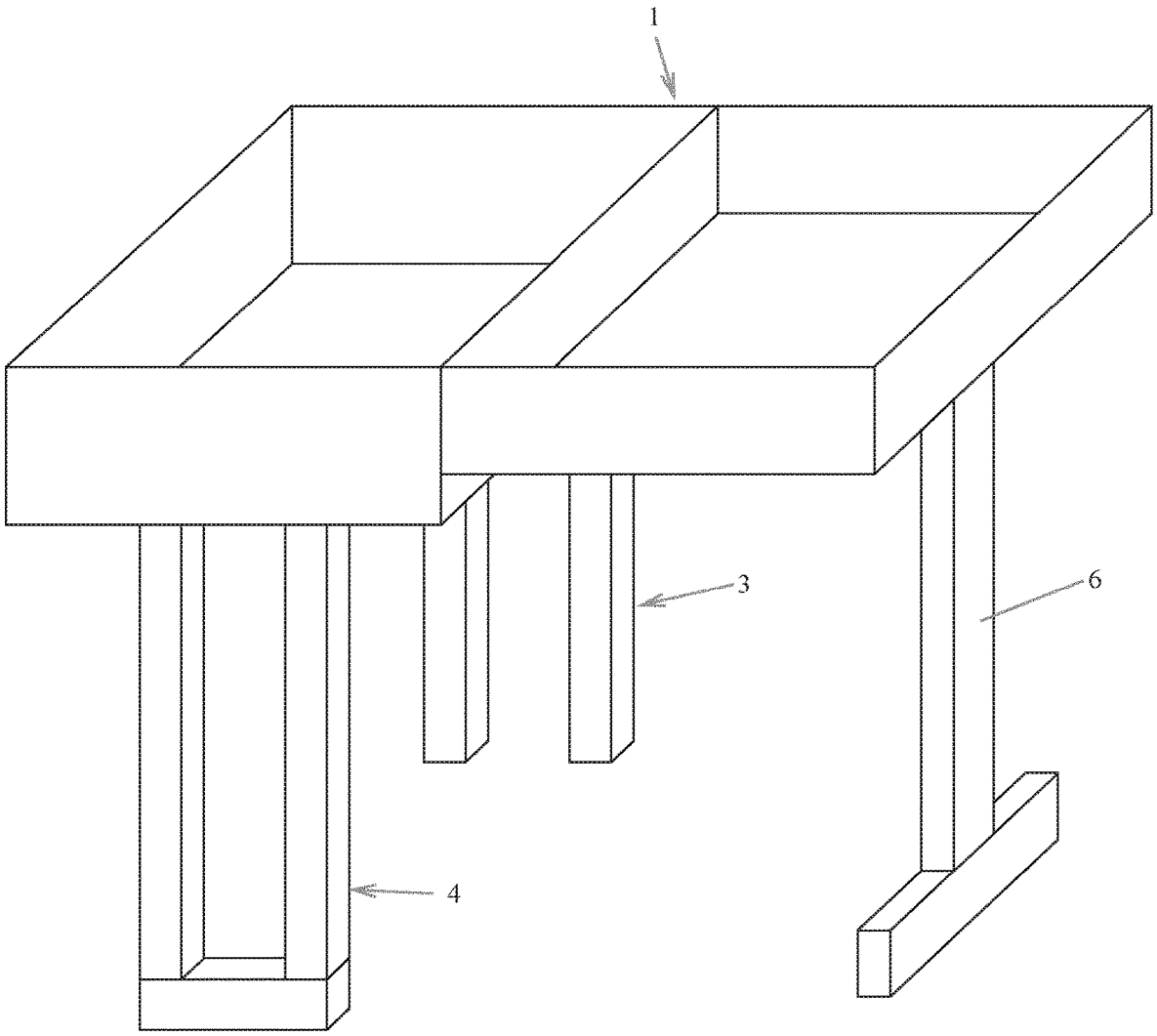
FIG. 6 illustrates a perspective view of the suitcase of FIG. 5 converted into a little table.

In this way, the half-shell without the handle 2 also has a point of support to the ground, as shown in FIG. 6. Advantageously, to allow the support arm 6 to be more easily accommodated on the body of the suitcase, it may be telescopic.

In an alternative embodiment, a plurality of support arms 6 may be present to increase their stabilizing effect.

To increase the ground support surface offered by the upper portion 4, it is possible to provide that the handle 11 has longitudinal projections that extend beyond the arms 10. Such projections may be retracted into the body of the handle if necessary.

The embodiment illustrated in the drawings is not to be understood by way of limitation and, for example, the handle 2 may not be visible, but it may be part of the wall on which it is placed so as to ensure a better aesthetic effect; even the arms 9, 10 may be in a number greater than two or a single arm 9 and a single arm 10 may be present.

Figure 7:
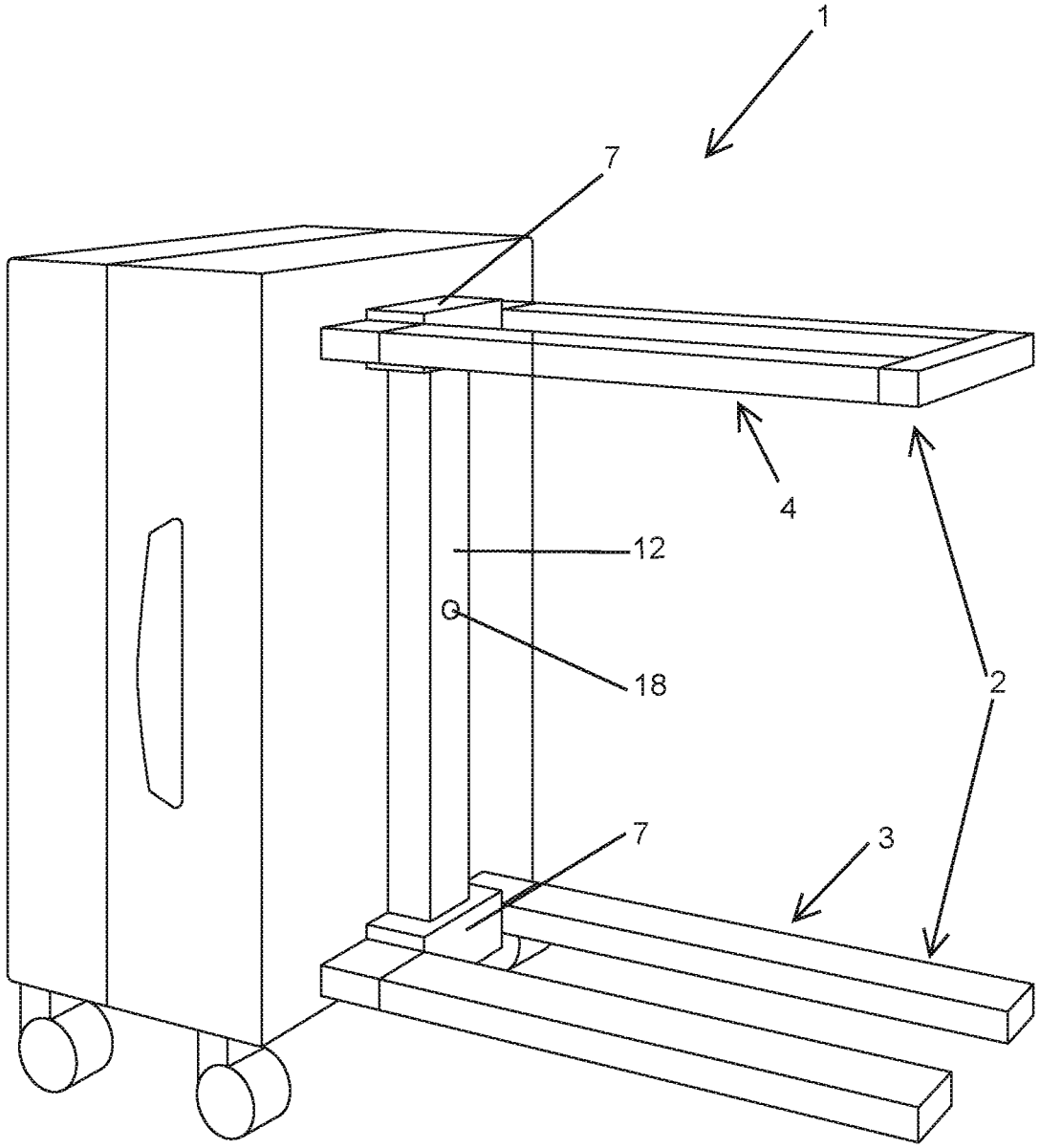
FIG. 7 illustrates a perspective view of a suitcase referred to in the invention in a particular embodiment thereof.
Figure 10:
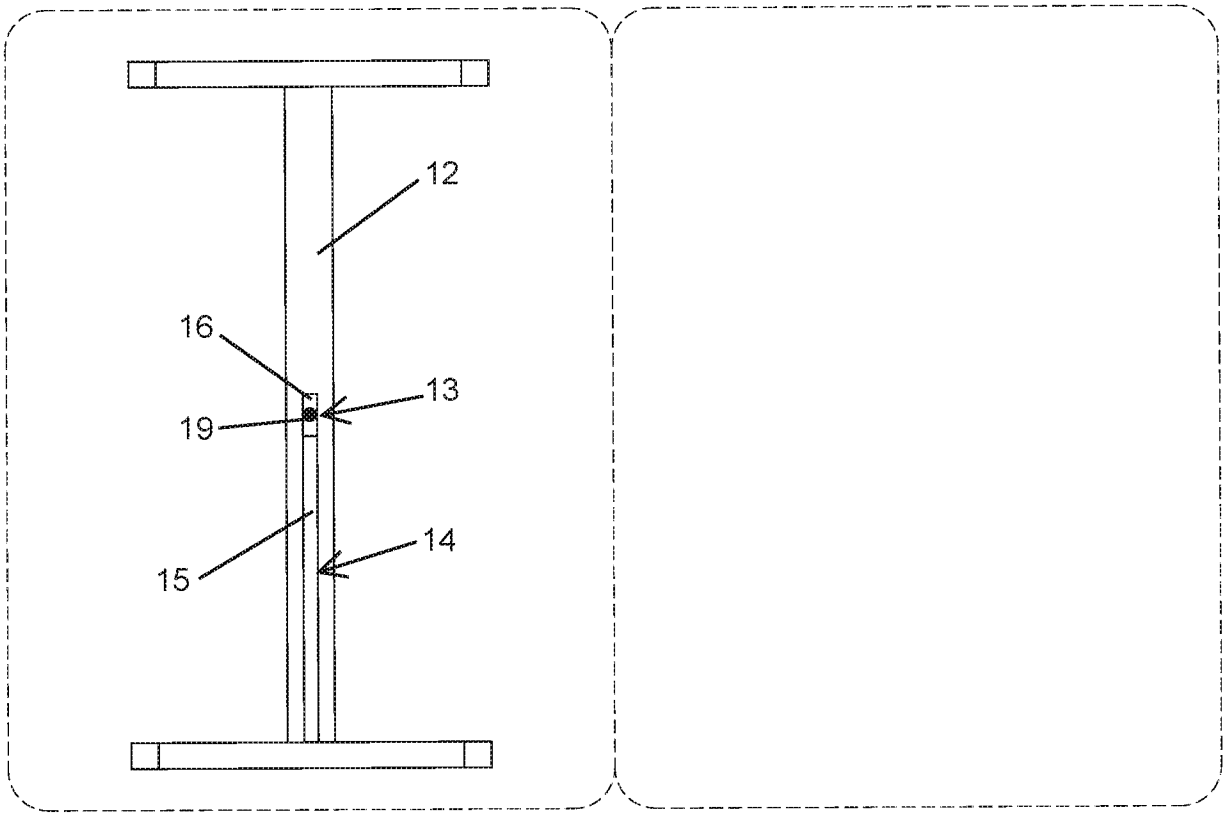
FIG. 10 illustrates a schematic top view of the suitcase of FIG. 7 opened in a first standard configuration.
Figure 11:
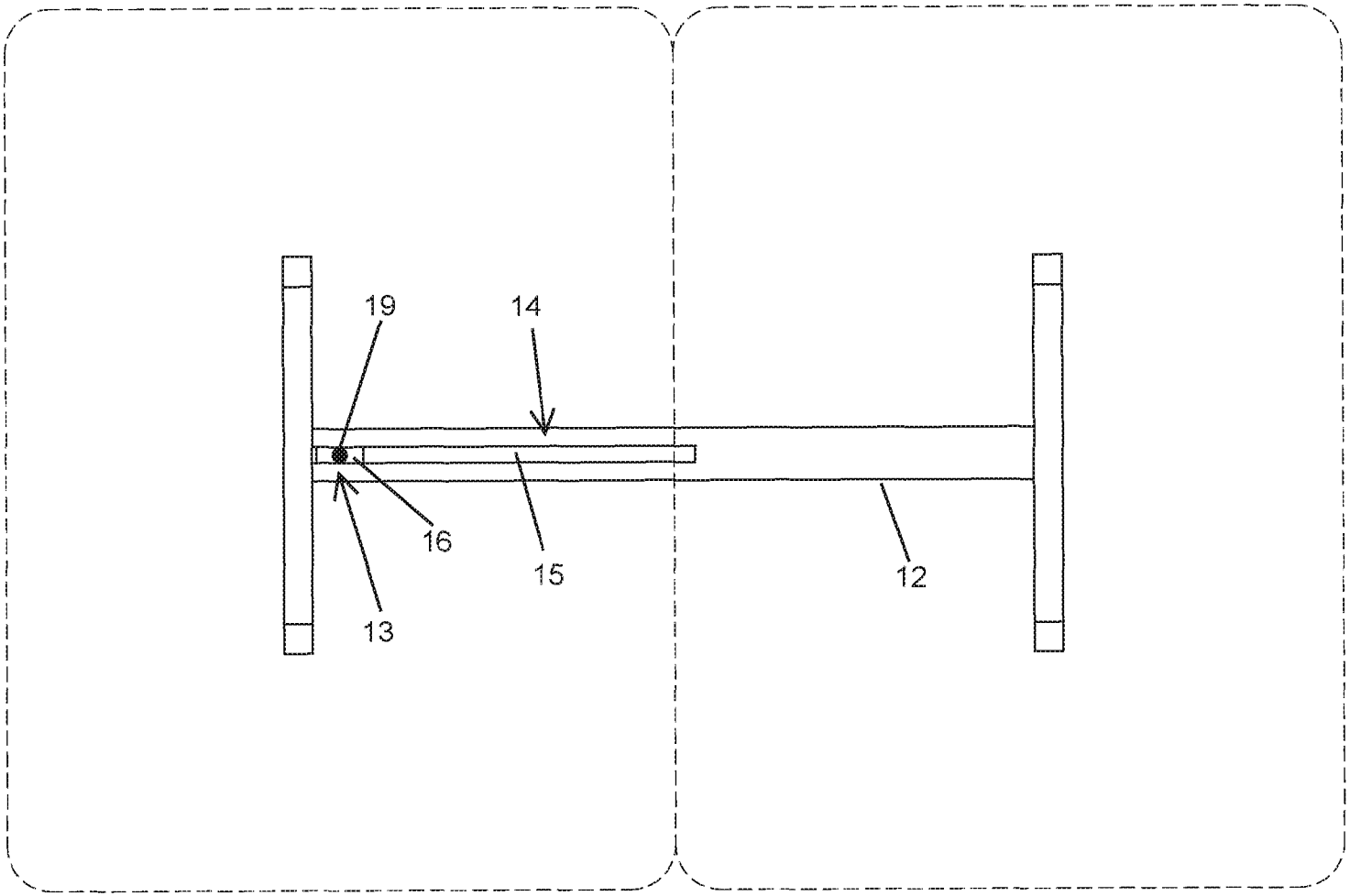
FIG. 11 illustrates a schematic top view of the suitcase of FIG. 7 opened in a second rotated configuration.
Figure 12:
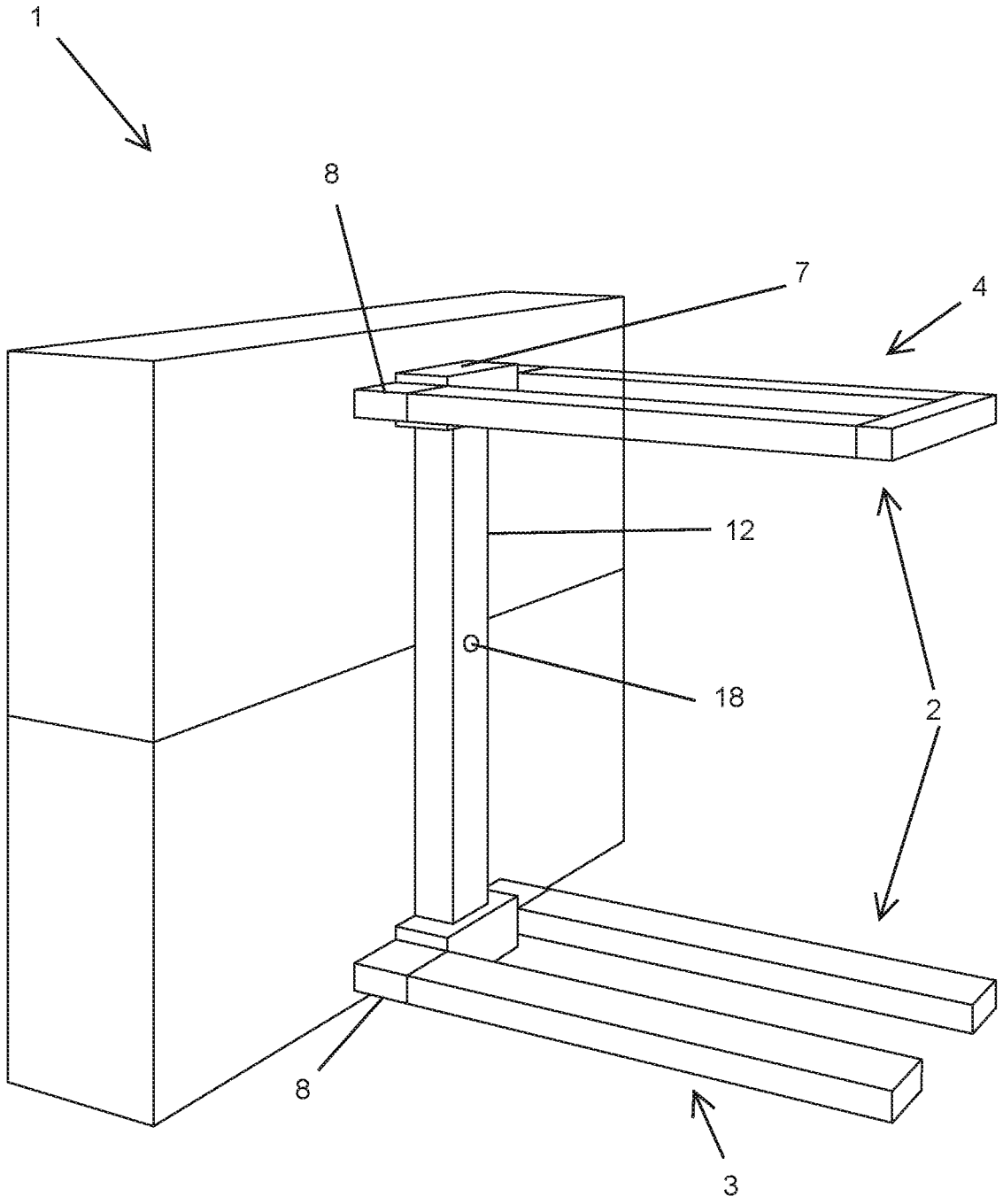
FIG. 12 illustrates a schematic perspective view of the suitcase of FIG. 7 opened in the second rotated configuration.

In the preferred embodiment of FIG. 7, a suitcase 1 of the invention has an adjustment bar 12 that connects the two central bodies 7 that are detachably fixed to the side wall. This embodiment is particularly useful because it allows to support the suitcase completely open (FIG. 10-11), that is with the two half-shells that compose it parallel to each other, by means of the handle 2 only.

Said bar 12 is fixed to the side wall by means of a rotatable coupling means 13 which, during normal use of the suitcase 1, is held locked by the central bodies 7 which are fixed to the side wall, while when the user detaches said central bodies 7 from the side wall it is free to rotate.

In this embodiment the central bodies 7 can be fixed to the side wall by reversible coupling means, such as, for example, a snap-in element, Velcro, snap buttons and the like.

This rotatable coupling means 13 is combined with a sliding means 14, thanks to which the bar 12 can move linearly with respect to it.

In this way, a user has the possibility of rotating the adjustment bar 12 by about 90° and of sliding it with respect to the rotatable coupling means, and consequently, with respect to the side wall of the suitcase 1, so as to bring one of the lower or upper portions 3, 4 below one of the two half-shells and the other one below the other half-shell, in order to support them both using only the handle 2.

In essence, the handle 2 can switch from a standard configuration, wherein it is parallel to the vertical development direction of the suitcase 1, to a rotated configuration, wherein it is orthogonal to said development direction.

Figure 8B:
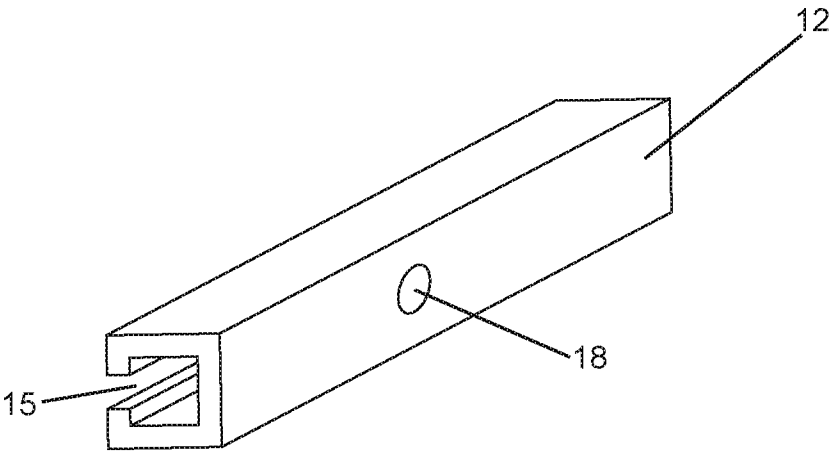
FIGS. 8A-B illustrate perspective views of an adjustment bar present in the embodiment of FIG. 7.
Figure 8A:
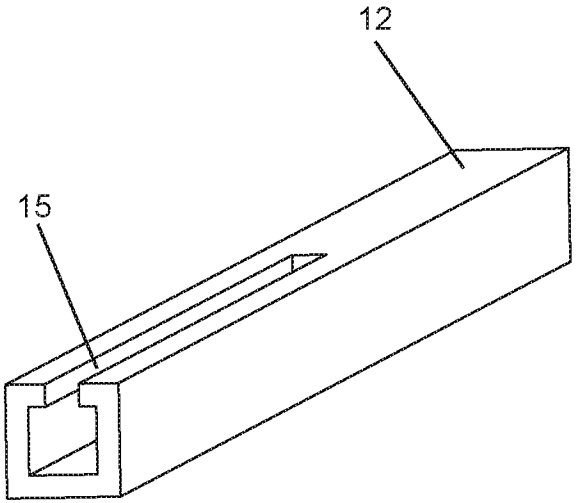
Figure 9:
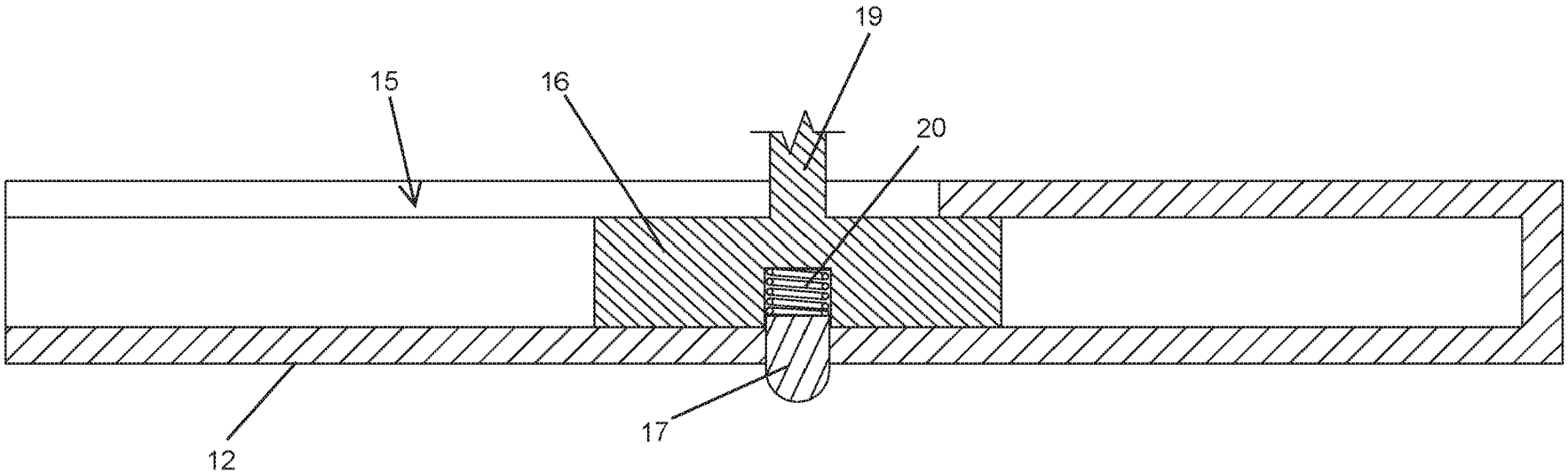
FIG. 9 illustrates a sectional view of the adjustment bar of FIGS. 8A-B.

FIGS. 8A-B and 9 illustrate an exemplary form of the inside of the hollow bar 12 and where inside it there is a sliding body 16 equipped with a pin 19, which emerges from the bar 12 through a slot 15 that runs along it in the longitudinal direction.

The pin 19 is free to rotate with respect to the sliding body 16 and is fixed at the outer end thereof to the bar 12 to the side surface of the suitcase 1, thus constituting the rotatable coupling means 13.

The sliding body 16, combined with the hollow inside of the bar 12 and with the slot 15, forms the sliding means 14.

The sliding body 16 is retained in position when the handle 2 is in its standard configuration by a stop means, consisting in this embodiment of a piston 17, which is retained in a hole 18 of the bar 12 by an elastic element 20, in this case constituted by a spring.

To unlock the sliding of the bar 12, the user can press the piston until it retracts inside the hole 18, releasing the sliding body 16.

From what has been described, it is therefore evident how the support device according to the invention is able to solve the typical problems of the products known in the state of the art, offering the user a simple, economical and versatile solution to have available a suitcase that can be converted into a little table.

Obviously, the technical design details and the components used, known in the state of the art and in evolution, can be the most varied, provided that all fall within the inventive concept defined by the following claims.

The invention claimed is:

1. A suitcase comprising:

on at least one side wall thereof, a handle comprising a lower portion and an upper portion, wherein each of said portions of the handle is hinged to the side wall by its own connection means, so as to be able to switch from a configuration wherein they are substantially parallel to said wall to one wherein they are substantially orthogonal to said wall, wherein the connection means between the side wall and the portions of the handle comprise a central body fixed to said wall and to which at least one rotatable side end is connected, able to rotate about an axis parallel to the side wall;

the upper portion being slidable through the relative rotatable side end and stop elements being provided to block said sliding, so as to adjust the vertical position of said upper portion;

wherein the lower portion is hollow and has at least one opening at its non-hinged end and the upper portion has a cross section having a dimension smaller than that of the lower portion, so that, while said portions are in a configuration parallel to the wall, the upper portion can slip into the lower portion.

2. The suitcase according to claim 1, wherein, at the side wall opposite to the one having the handle, at least one support arm hinged to said wall is provided, so as to be able to switch from a configuration wherein the support arm is substantially parallel to said wall, to a configuration wherein the support arm is substantially perpendicular to said wall.

3. The suitcase according to claim 2, wherein the support arm is telescopic.

4. The suitcase according to claim 1, comprising two rotatable side ends.

* * * * *